US010744814B1

(12) United States Patent
Zumot

(10) Patent No.: US 10,744,814 B1
(45) Date of Patent: Aug. 18, 2020

(54) ETCH A SKETCH TOOL WITH REMOVABLE AND REPLACABLE GLASSES AND METHOD THEREOF

(71) Applicant: Anton Zumot, Castro Valley, CA (US)

(72) Inventor: Anton Zumot, Castro Valley, CA (US)

( * ) Notice: Subject to any disclaimer, the term of this patent is extended or adjusted under 35 U.S.C. 154(b) by 196 days.

(21) Appl. No.: 15/982,372

(22) Filed: May 17, 2018

(51) Int. Cl.
*B43L 1/12* (2006.01)
*B43L 13/04* (2006.01)

(52) U.S. Cl.
CPC ..... *B43L 1/12* (2013.01); *B43L 13/046* (2013.01)

(58) Field of Classification Search
CPC ..... B43L 1/12
USPC ..... 33/18.1
See application file for complete search history.

(56) References Cited

U.S. PATENT DOCUMENTS 3,055,113 A 9/1962 Chaze
3,760,505 A 9/1973 Clark
4,135,303 A * 1/1979 Gresset ..... A63H 33/22 33/18.1
4,369,579 A * 1/1983 Mizoule ..... B43L 13/00 33/1 M
4,451,985 A * 6/1984 Pullman ..... A63H 33/22 33/18.1
4,801,266 A * 1/1989 Kinberg ..... B43L 1/123 33/18.1
4,856,197 A * 8/1989 Auer ..... B43L 1/00 33/18.1
4,888,874 A * 12/1989 Oster ..... A63H 33/22 33/18.1
4,900,148 A * 2/1990 Doerr ..... B23Q 1/5481 356/244
5,038,482 A * 8/1991 Anderson ..... G09B 27/08 33/21.2
5,212,874 A * 5/1993 Anderson ..... B43L 1/12 33/18.1
5,333,387 A * 8/1994 Ankenbruck ..... B43L 13/046 33/1 M
5,867,914 A * 2/1999 Watson ..... B43L 1/00 33/18.1
7,158,111 B1 * 1/2007 Jackson ..... G02F 1/091 345/107
2014/0170603 A1 * 6/2014 Ranftl ..... B43L 1/004 434/81
2019/0321742 A1 * 10/2019 Pruzansky ..... B43L 1/00

* cited by examiner

*Primary Examiner* — George B Bennett
(74) *Attorney, Agent, or Firm* — Sanchelima & Associates, P.A.; Christian Sanchelima; Jesus Sanchelima

(57) ABSTRACT

The present invention is etch a sketch tool that are used by sketchers for preparing various sketches and when one sketch is prepared sketcher/user can remove sketches without destructing etch a sketch tool which can then be re-used. Etch a sketch tool includes a lower enclosure, a glass resting frame, a hinge connection, a lower gasket, a glass, an upper gasket, an upper enclosure, a pair of knobs and a locking system. Upper enclosure is unlocked from lower enclosure. Upper enclosure is lifted, upper enclosure is spaced apart from lower enclosure and glass is removed therefrom. Glass is thus carefully removed from etch a sketch tool and a new glass can be replaced. Once new glass is replaced, upper enclosure can be locked with lower enclosure. Thus, etch a lock tool can be re-used again.

20 Claims, 5 Drawing Sheets

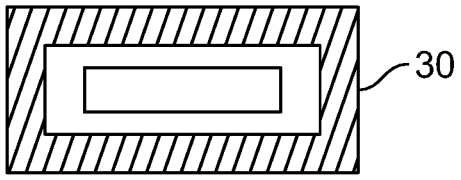
FIG. 6A
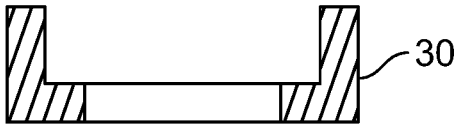
FIG. 6B
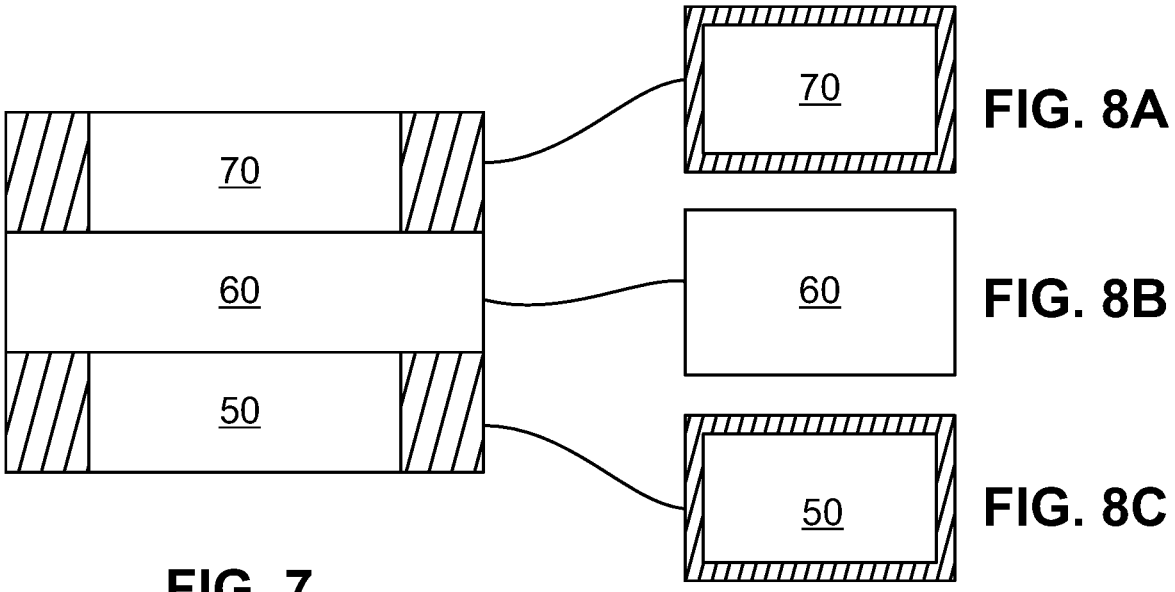
FIG. 8A
FIG. 8B
FIG. 8C
FIG. 7

ETCH A SKETCH TOOL WITH REMOVABLE AND REPLACABLE GLASSES AND METHOD THEREOF

II. BACKGROUND OF THE INVENTION

1. Field of the Invention

The present disclosure relates to an Etch A Sketch tool used for sketching. More particularly, the present disclosure relates to Etch A Sketch tool that enables sketching of various sketches without destroying the earlier ones.

2. Description of the Related Art

Etch A Sketch tool is a sketching tool used for sketching. Existing Etch A Sketch tool is a non-openable enclosure that encloses a glass positioned on upper portion of non-openable enclosure. Beneath glass is an enclosed space in which aluminum powder and balls like polystyrene beads are provided that helps even flow of aluminum powder and prevent it from caking. Along with aluminum powder and polystyrene beads, a stylus is provided that is in contact with lower surface of glass. Stylus is movable by use of a stylus moving mechanism (or crosshair moving mechanism) provide under glass and operable by use of knobs provided on upper surface of non-openable enclosure. In operation, Etch A Sketch tool is shaken which causes coating of aluminum powder on lower surface of glass and when stylus is moved, sketch (such as lineographic sketch) is created. If sketcher wants to sketch another sketch, then etch a sketch tool is again shaken which causes re-coating of aluminum powder on lower surface of glass thereby erasing out the earlier sketch. Hence, sketches cannot be saved in present form of tool unless sketched glass is removed. However, removal of glass is a difficult task because of enclosure which is of non-openable type. Enclosure is required to be permanently damaged by cutting enclosure and thereafter remove glass. Also, during cutting, Etch A Sketch tool can be accidentally shaken that results in re-coating on glass thereby destroying sketch.

Several designs of various Etch A Sketch tools have been designed in the past. None of them, however, include a feature of easily removing etched glass without physically destroying the Etch A Sketch tool and replacing new glass for further use.

Applicant believes that a related reference corresponds to U.S. Pat. No. 3,760,505 filed by Ohio Art Co. titled 'Tracing device' discloses any glass from escaping in the event the toy is dropped or the transparent glass tracing surface is broken, thus materially improving the safety of the toy or game for children. However, the system does not explicitly mention about saving on the sketch/art prepared by sketchers.

U.S. Pat. No. 3,055,113 filed by Paul Chaze titled 'Tracing device' discloses that a tracing device adapted to trace on a transparent surface all the lines, symbols, drawings, letter-press which may be desired and to wipe them out instantaneously. However, the device does not explicitly mention about preserving such lines, symbols, drawings, letter-press.

Other documents describing the closest subject matter provide for a number of more or less complicated features that fail to solve the problem in an efficient and economical way. None of these patents suggest the novel features of the present invention.

III. SUMMARY OF THE INVENTION

In view of the above, it is an objective of the present invention to solve or at least reduce the problems discussed above. The present invention is an Etch A Sketch tool that enables sketchers to prepare sketch and preserve the sketch by removing prepared sketch. Also, Etch A Sketch tool can be re-used for preparing new sketches. Etch A Sketch tool includes a lower enclosure with an integral glass resting frame configured on upper surface of lower enclosure, a hinge connection, a lower gasket, a glass, an upper gasket, an upper enclosure, a pair of knobs and a locking system. When a sketcher has finished etching or preparing sketches on a glass by manipulating knobs, user may wish to preserve the sketch and therefore un-lock locking system and lift upper enclosure. Upon lifting of upper enclosure, glass that is etched and is required to be preserved can be easily lifted and removed by user for framing and a new glass can be positioned thereon, rendering etch a glass sketch tool for re-use. In another way, when lower enclosure is in hinge connection with glass resting frame and when upper enclosure is lifted, glass resting frame also lifts, because of hinge connection, and thereby lifting lower gasket, glass and upper gasket. Further, lifting of glass resting frame causes tilting which removes upper gasket, glass and lower gasket. Glass can then be framed which can be used for further use like selling, exhibiting or decoration purpose. New glass can be positioned between upper gasket and lower gasket and be fitted in glass resting frame. Upper enclosure can then be locked with lower enclosure and Etch A Sketch tool is ready for use again. Thus, etched glass can be removed for preserving and replaced with another glass for performing etching.

It is one of the main objects of the present invention is to provide an Etch A Sketch tool and method that easily enables removing etched glass for preserving and replace with another glass for performing etching.

It is another object of this invention is to provide an Etch A Sketch tool and method that is easy for removing and inserting glasses.

It is another object of this invention is to provide an Etch A Sketch tool that is cost-efficient.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 1:
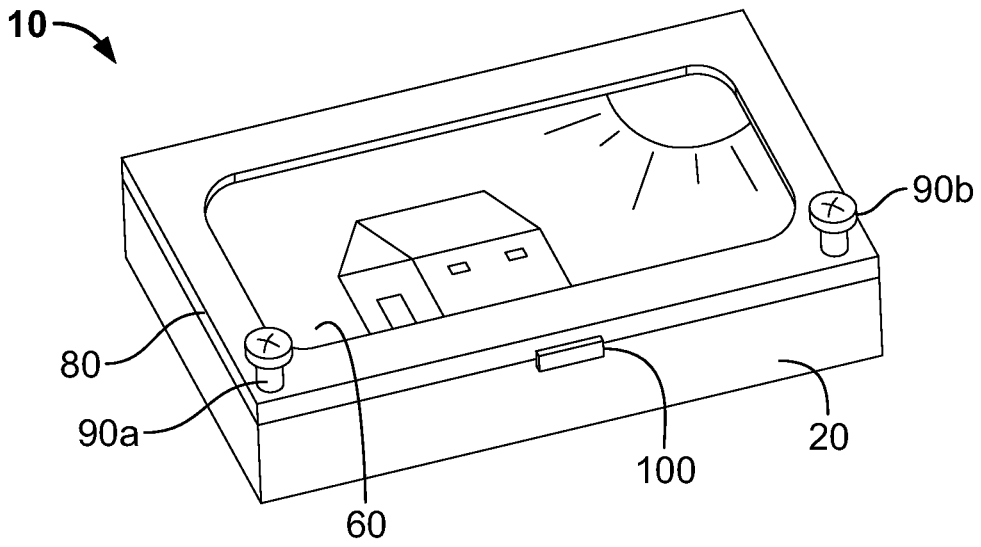
FIG. 1 represents a perspective frontal view of Etch A Sketch tool in a closed configuration, in accordance with one embodiment of the present invention.
Figure 2:
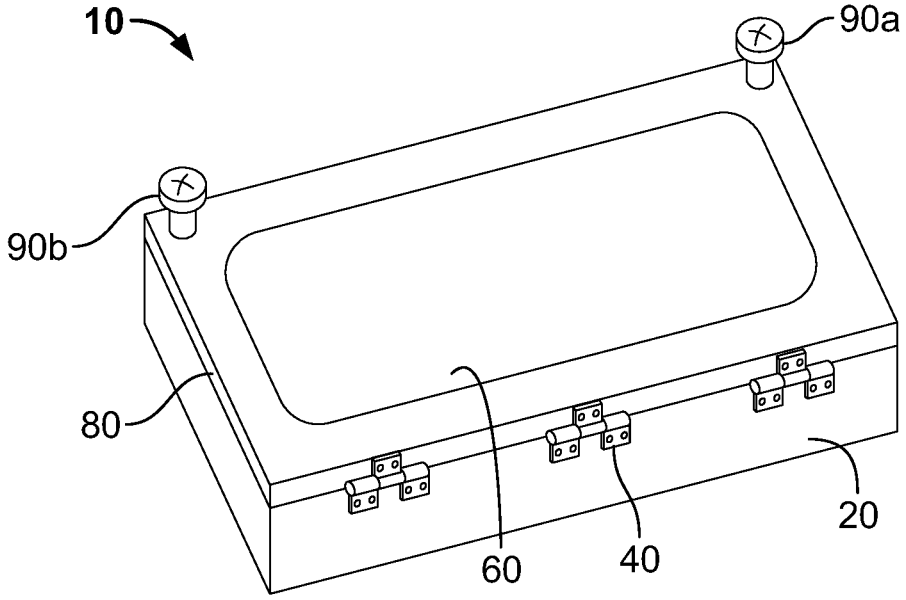
FIG. 2 shows a perspective back view of Etch A Sketch tool of FIG. 1, wherein Etch A Sketch tool is in closed configuration.
Figure 3A:
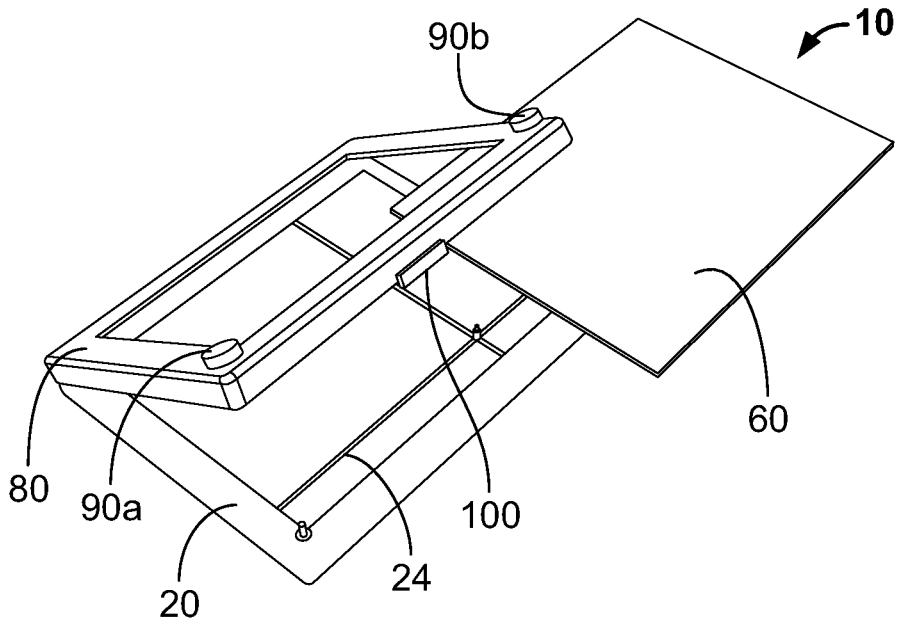
Figure 3B:
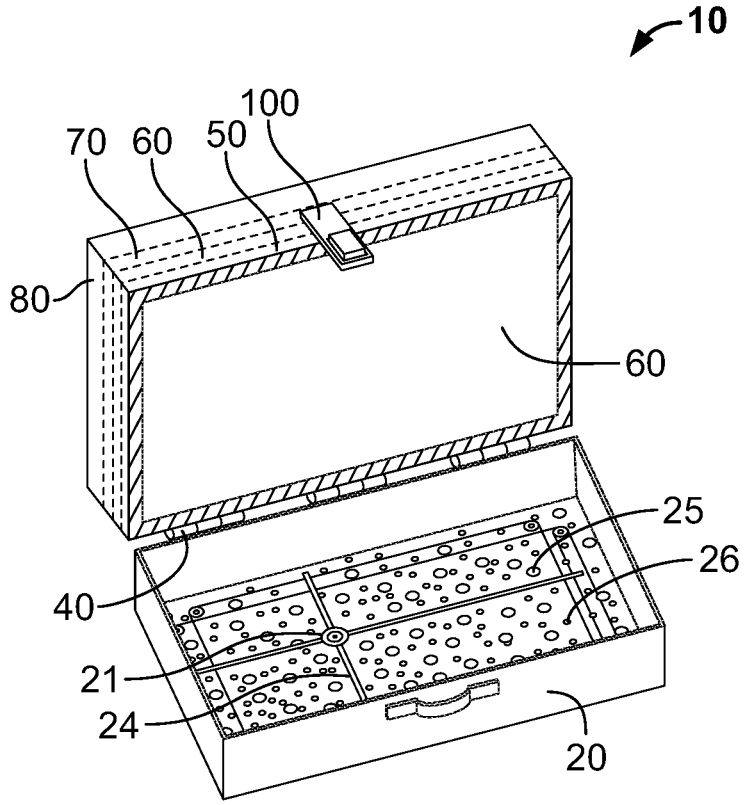
Figure 4:
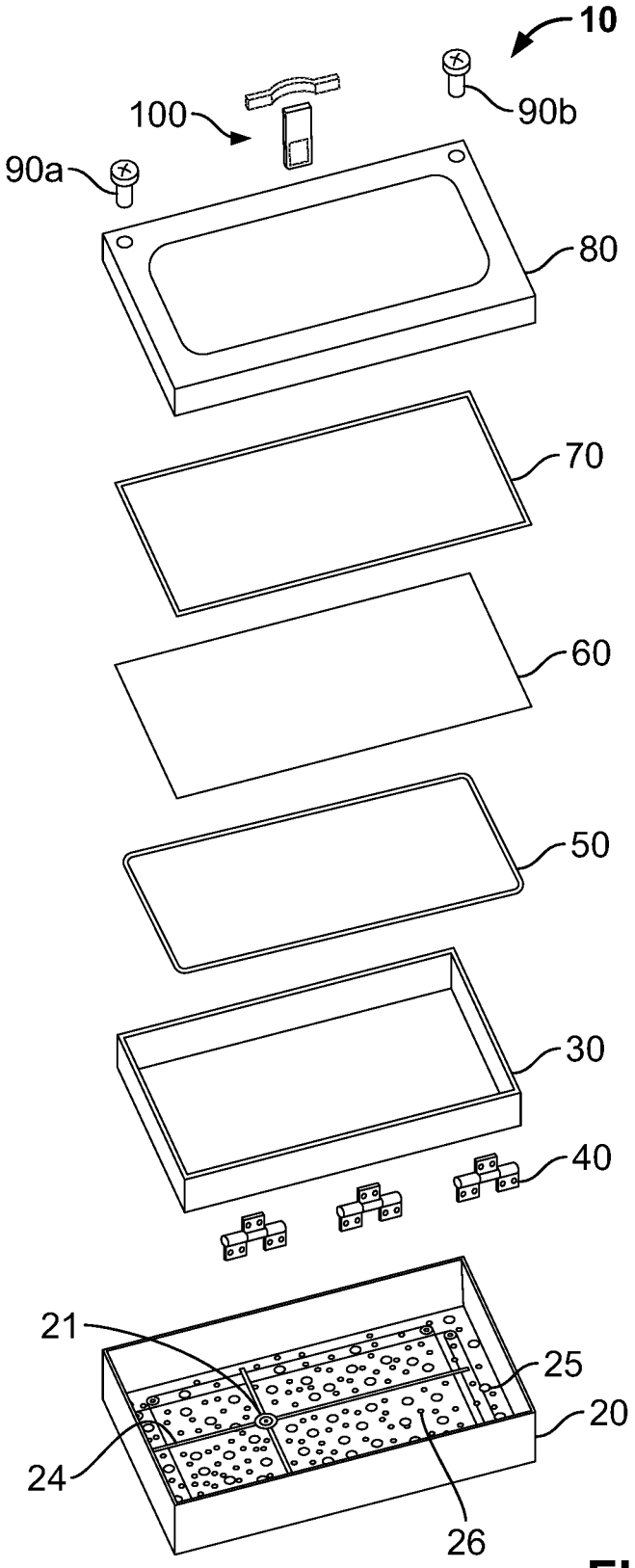
Figure 5:
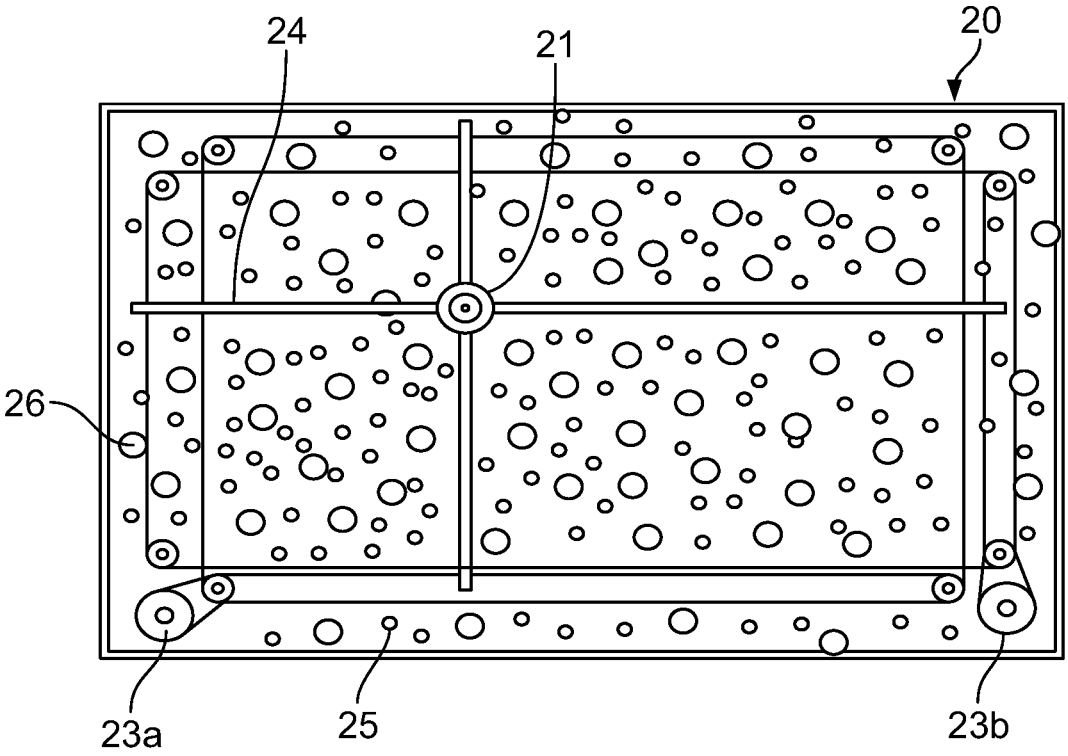

FIG. 3*a* shows a perspective view of Etch A Sketch tool of FIG. 1, wherein Etch A Sketch tool is in an open configuration, in accordance with one embodiment of the present disclosure;

FIG. 3*b* shows a perspective view of Etch A Sketch tool of FIG. 1, wherein Etch A Sketch tool is in an open configuration, in accordance with another embodiment of the present disclosure;

FIG. 4 illustrates an exploded view of Etch A Sketch tool of FIG. 1;

FIG. 5 illustrates a top view of lower enclosure of Etch A Sketch tool of FIG. 1;

FIGS. 6*a* and 6*b* illustrate a sectional top view and sectional front view of a glass resting frame of Etch A Sketch tool of FIG. 1;

FIG. 7 illustrate an assembled view of glass seated between upper gasket and lower gasket, wherein glass, upper gasket and lower gasket are of Etch A Sketch tool of FIG. 1; and FIGS. 8*a*, 8*b*, and 8*c* illustrate top views of upper gasket, glass and lower gasket respectively.

V. DETAILED DESCRIPTION OF THE EMBODIMENTS OF THE INVENTION

Referring now to the drawings (FIGS. 1 to 8*c*), where the present invention is generally referred to with numeral 10, it can be observed that Etch A Sketch tool, in accordance with an exemplary embodiment that includes a lower enclosure 20, a glass resting frame 30, a hinge connection 40, a lower gasket 50, a glass 60, an upper gasket 70, an upper enclosure 80, a pair of knobs 90*a* and 90*b* and a locking system 100.

Lower enclosure 20 has a cavity 20*a* that accommodates a stylus 21, a stylus moving mechanism, aluminum powder 25 and balls 26. Stylus moving mechanism moves stylus 21 horizontally, vertically, diagonally or combinations/diagonally thereof. In one embodiment, stylus moving mechanism mainly includes pulleys 23*a* and 23*b* and rods 24. Pulleys 23*a* and 23*b* are manually rotated/operated by knobs 90*a* and 90*b*. Rotation of pulleys 23*a* and 23*b* moves rods 24 and thus moves stylus 21 disposed on rods 24. Movement of stylus 21 enables etches on glass 60 which is coated with aluminum powder 25. Aluminum powder 25 in desired quantity is provided. Aluminum powder 25 is used because it easily adheres to glass 60 thereby making glass 60 opaque. Other powders that can similarly make glass 60 opaque can be used in place of aluminum powder 25. Balls 26 like, but not limited to, polystyrene beads are provided that helps even flow of aluminum powder 25 and prevent it from caking. Lower enclosure 20 can be of any material, size and shape.

In depicted embodiment as illustrated in FIG. 3*a*, glass resting frame 30 is integral part of lower enclosure 20. Moreover, upper portion of lower enclosure 20 acts as glass resting frame 30 and provides support to glass 60.

In another depicted embodiment as illustrated in FIG. 3*b*, Glass resting frame 30 is in hinge connection 40 with lower enclosure 20. In closed configuration, glass resting frame 30 rests on lower enclosure 20. In the open configuration, glass resting frame 30 is stationary while upper enclosure 80 is pivotally lifted. Glass resting frame 30 mainly supports glass 60 and has a central/middle opening 30*a* that facilitates contact between glass 60 with stylus and aluminum powder 25. Glass resting frame 30 can be of any material that can be able to withstand load of glass 60.

Lower gasket 50 is positioned and rests either on upper portion of lower enclosure 20 which acts as glass resting frame 30 or on glass resting frame 30 which is hinged with lower enclosure 20. Glass 60 is positioned on lower gasket 50. In either of cases described above, other opaque element can be used instead of glass 60 that is transparent, however, can be coated to form opaque. Upper gasket 70 is positioned on glass 60 such that glass 60 is sandwiched between lower gasket 50 and upper gasket 70. In open configuration, as lower gasket 50, glass 60 and upper gasket 70 are seated on glass resting frame 30, lifting of glass resting frame 30 lifts lower gasket 50, glass 60 and upper gasket 70.

Upper enclosure 80 is in hinge connection 40 with lower enclosure 20 and/or glass resting frame 30. Upper enclosure 80 can be of any material, size and shape. In closed configuration, upper enclosure 80 and lower enclosure 20 are connected and locked with each other by use of locking system 100 to form a closed configuration and thereby forms an enclosure for Etch A Sketch tool. In open configuration, upper enclosure 80 and lower enclosure 20 can be spaced apart by unlocking locking system 100. Locking system 100 can be of any type that can easily lock and unlock upper enclosure 80 and lower enclosure 20 with less effort. Locking system 100 can be a slidable lock as illustrated in FIG. 3*a* or locking system 100 can be a press button as illustrated in FIG. 3*b*. In yet another type, locking system 100 or can be integral with upper enclosure 80 and lower enclosure 20 to achieve a press fit therebetween. The present disclosure is not limited to the above described locking systems and other types of locking systems that can easily lock and un-lock upper enclosure and lower enclosure is within the scope of the present disclosure.

Knobs 90*a* and 90*b* are fitted on pulleys 23*a* and 23*b* respectively. Knobs 90*a* and 90*b* are provided above the upper enclosure 80 and are manually operated by sketches while sketching. Knob 90*a* moves stylus 21 horizontally, knob 90*b* moves stylus 21 vertically and operation of both knobs 90*a* and 90*b* simultaneously provides drawing an arc, curves, circle, spherical and like non-linear shapes. In exemplary embodiments, knobs 90*a* and 90*b* are either screwed for being connected with rods 24 or have a magnet (not illustrated in Figures) provided in each of the knobs 90*a* and 90*b* which is easily adhered to a seat, typically formed of gear like shape which secures the knobs 90*a* and 90*b* and prevent from falling off during etching operations. Provision of magnets and seat provides easy removal and placement of knobs 90*a* and 90*b* and also can be standardized and customized. Material and size of knobs 90*a* and 90*b* can be selected as per requirement.

The present disclosure also discloses a method for removing and replacing glass 60 in etch a sketch tool 10. Initially considering that glass 60 is fitted in etch a sketch tool 10 and etch a sketch tool 10 is in closed (locked) configuration. In case if glass 60 is transparent, etch a sketch tool 10 is shaken or turned upside down so that aluminum powder 25 adhere to bottom surface of glass 60. Sketcher can manipulate knobs 90*a* and 90*b* to move stylus 21 that etches glass 60 coated with aluminum powder 25 and thereby draw a sketch.

In one embodiment, once the sketch is prepared and sketcher wants to preserve sketch, then sketcher/user initially removes/dismantles knobs 90*a* and 90*b*. In the present disclosure 'user' is used to describe a trainer, parent, guardian or any other human. Once knobs 90*a* and 90*b* are removed/dismantled, locking system 100 is manipulated (typically by sliding) to open and space apart upper enclosure 80 and lower enclosure 20. When glass resting frame 30 is integral part of lower enclosure 20 and when user lifts upper enclosure 80, then upper gasket 70 which is secured to upper enclosure 80 is lifted along with upper enclosure 80 and glass 60 which is etched and which is seated on lower enclosure 20 is easily lifted and removed. Thereafter, lifted glass 60 is positioned on surface that can be used for framing glass 60 and thus preserve the sketch etched on glass 60. In other way, knobs 90*a* and 90*b* may not be completely removed but are loosened enough for partial lifting of upper enclosure 80 and removal of glass 60 therefrom. Once done, sketcher/user can take another glass and position of lower enclosure 20 and then close upper enclosure 80 and lock (by sliding) locking system 100, rendering Etch A Sketch tool 10 for re-use.

Alternatively, when glass resting frame 30 is in hinge connection with lower enclosure 20, then upper enclosure 80 is first lifted after removal of knobs 90*a* and 90*b* and then glass resting frame 30 is lifted. Lifting of glass resting frame 30 provides easiness for removal of glass 60 that is etched. Moreover, glass resting frame 30 is tilted and upper gasket 70 is removed. Thenafter, glass 60 that is etched is removed. Once the glass 60 that is etched is removed, glass 60 that is etched can be positioned on surface that can be used for framing glass 60 and thus preserve the sketch etched on glass 60. Glass 60 is easy to remove because of use of upper gasket 70 and lower gasket 50 that prevents glass 60 to stick with upper enclosure 80 and lower enclosure 20. When sketcher wants to prepare another sketch, then sketcher/user first check available aluminum powder 25 and/or rods 24 present in lower enclosure 20 and if found not in adequate quantity then sketcher/user add on more aluminum powder 25 and/or rods 24 that are separately purchasable. Once done, sketcher/user rests glass resting frame 30 on lower enclosure 20 and then inserts in sequence lower gasket 50, a new glass and upper gasket 70. Upper enclosure 80 is then locked with locking system 100. Locking of upper enclosure 80 resets Etch A Sketch tool 10. Etch A Sketch tool 10 is shaken or turned upside-down for aluminum powder 25 to coat new glass. Etch A Sketch tool 10 is ready for use again. Thus, Etch A Sketch tool is easily enables removing etched glass for preserving and replace with another glass for performing etching.

As Etch A Sketch tool 10 is not required to be physically damaged and purchasing each time a new traditional-type Etch A Sketch tool is not pocket friendly, hence, Etch A Sketch tool 10 of the present disclosure is cost-effective.

In another embodiment of Etch A Sketch tool of present disclosure, any of the side walls of enclosure can be configured to slide outward and glass can be removed. The sidewall can then be provided with a new glass and slide back again for re-use.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An Etch A Sketch tool, comprising:

a lower enclosure, a glass resting frame within said lower enclosure, hinge connections hingedly mounting said lower enclosure to an upper enclosure, said hinge connections being mounted to a rear exterior of said lower enclosure and said upper enclosure, said hinge connections being evenly spaced apart, said hinge connections extending about a length of said lower enclosure and said upper enclosure, a glass between said glass resting frame and said upper enclosure, a pair of removable knobs mounted on said upper enclosure, a locking system securing and locking said upper enclosure to said lower enclosure, said locking system extending horizontally along said upper enclosure, pulleys and rods manually operated by said knobs to determine where said glass is to be coated by aluminum powder.

2. The Etch A Sketch tool of claim 1 wherein said lower enclosure includes a cavity adapted to receive a stylus.

3. The Etch A Sketch tool of claim 1 having a stylus moving mechanism that moves said stylus horizontally, vertically, and diagonally.

4. The Etch A Sketch tool of claim 1 having balls being polystyrene beads within said aluminum powder adapted to help the flow of said aluminum powder.

5. The Etch A Sketch tool of claim 1 wherein said glass resting frame is an integral part of said lower enclosure.

6. The Etch A Sketch tool of claim 1 wherein said glass resting frame is in hinge connection with said lower enclosure, a closed configuration defined by said glass resting frame resting on said lower enclosure, an open configuration defined by said glass resting frame being stationary while said upper enclosure is pivotally mounted.

7. The Etch A Sketch tool of claim 6 wherein a lower gasket, said glass, and an upper gasket are seated on said glass resting frame in said open configuration, lifting said glass resting frame lifts said lower gasket, said glass, and said upper gasket, said upper gasket positioned on said glass such that said glass is sandwiched between said lower gasket and said upper gasket.

8. The Etch A Sketch tool of claim 1 wherein said locking system is a slidable lock.

9. The Etch A Sketch tool of claim 1 wherein said knobs are mounted to said upper enclosure using magnets.

10. The method of using the Etch A Sketch tool of claim 1, comprising:

a. removing knobs from said upper enclosure;

b. unlocking said locking system;

c. lifting said upper enclosure; and d. removing said glass.

11. The Etch A Sketch tool of claim 1, wherein said hinge connections are evenly spaced apart and parallel to each other.

12. The Etch A Sketch tool of claim 1, wherein said hinge connections partially cover said lower enclosure and said upper enclosure.

13. The Etch A Sketch tool of claim 1, wherein said hinge connections are vertical when said lower enclosure and said upper enclosure are locked together.

14. The Etch A Sketch tool of claim 1, wherein said hinge connections fold rearwardly when upper enclosure is lifted from said lower enclosure.

15. The Etch A Sketch tool of claim 1, wherein said hinge connections and said locking system are perpendicular to each other when said lower enclosure and said upper enclosure are locked together.

16. The Etch A Sketch tool of claim 1, wherein said hinge connections extend about an entire height of said upper enclosure.

17. The Etch A Sketch tool of claim 1, wherein said hinge connections extend a partial height of said lower enclosure.

18. The Etch A Sketch tool of claim 1, wherein said glass is removable and frameable.

19. The Etch A Sketch tool of claim 1, wherein said locking system is integral with said upper enclosure and said lower enclosure to achieve a press fit therebetween.

20. The Etch A Sketch tool of claim 3, wherein said glass resting frame has a central opening allowing contact between said glass with said stylus and said aluminum powder.

* * * * *